US010578987B2

(12) United States Patent
Watanabe et al.

(10) Patent No.: US 10,578,987 B2
(45) Date of Patent: Mar. 3, 2020

(54) METHOD FOR PRODUCING TONER FOR ELECTROPHOTOGRAPHY

(71) Applicant: KAO CORPORATION, Tokyo (JP)

(72) Inventors: Shogo Watanabe, Izumiotsu (JP); Kotaro Shimada, Wakayama (JP); Arisa Yamamoto, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 15/998,956

(22) PCT Filed: Feb. 17, 2017

(86) PCT No.: PCT/JP2017/005895

§ 371 (c)(1),
(2) Date: Aug. 17, 2018

(87) PCT Pub. No.: WO2017/145932

PCT Pub. Date: Aug. 31, 2017

(65) Prior Publication Data

US 2019/0227448 A1 Jul. 25, 2019

(30) Foreign Application Priority Data

Feb. 22, 2016 (JP) ..... 2016-031041

(51) Int. Cl.
*G03G 9/08* (2006.01)
*G03G 9/087* (2006.01)

(52) U.S. Cl.
CPC ..... *G03G 9/0806* (2013.01); *G03G 9/081* (2013.01); *G03G 9/0808* (2013.01); *G03G 9/0821* (2013.01); *G03G 9/08711* (2013.01); *G03G 9/08742* (2013.01); *G03G 9/08755* (2013.01); *G03G 9/08782* (2013.01); *G03G 9/08795* (2013.01); *G03G 9/08797* (2013.01)

(58) Field of Classification Search
CPC ..... G03G 9/0808; G03G 9/081; G03G 9/0821
USPC ..... 430/137.1
See application file for complete search history.

(56) References Cited

U.S. PATENT DOCUMENTS

2014/0349232 A1 11/2014 Kinumatsu et al.
2015/0153667 A1 6/2015 Noji et al.

FOREIGN PATENT DOCUMENTS

| | | | |
|---|---|---|---|
| JP | 2003-302785 | A | 10/2003 |
| JP | 2005-221570 | A | 8/2005 |
| JP | 2010-145550 | A | 7/2010 |
| JP | 2012-97133 | A | 5/2012 |
| JP | 2014-32232 | A | 2/2014 |
| JP | 2014-109704 | A | 6/2014 |
| JP | 2015-4972 | A | 1/2015 |
| JP | 2015-31767 | A | 2/2015 |
| JP | 2015-210278 | A | 11/2015 |

OTHER PUBLICATIONS

Extended European Search Report dated Aug. 1, 2019 in Patent Application No. 17756371.5, 7 pages.
International Search Report dated Mar. 21, 2017 in PCT/JP2017/005895 filed Feb. 17, 2017.

*Primary Examiner* — Mark A Chapman
(74) *Attorney, Agent, or Firm* — Oblon, McClelland, Maier & Neustadt, L.L.P.

(57) ABSTRACT

The present invention relates to a process for producing a toner for electrophotography that is excellent in the low-temperature fusing property, the initial image quality after storage, and the document offset property. A process for producing a toner for electrophotography, including step 1: melt-mixing a mixture containing a crystalline resin (C) and ester wax (W) having a dipentaerythritol unit as a constitutional component, wherein a difference $|C_{mp}-W_{mp}|$ between a melting point $C_{mp}$ of the crystalline resin (C) and a melting point $W_{mp}$ of the ester wax (W) is 30° C. or less, and the melt-mixing is performed at a temperature $K_t$ that is the melting point $C_{mp}$ or more and the melting point $W_{mp}$ or more.

20 Claims, No Drawings

METHOD FOR PRODUCING TONER FOR ELECTROPHOTOGRAPHY

FIELD OF THE INVENTION

The present invention relates to a process for producing a toner for electrophotography.

BACKGROUND OF THE INVENTION

According to the speeding up and energy saving of printers and duplicators in recent years, a toner meeting these requirements is getting to be necessary.

PTL 1 describes, as a means for solving a problem of achieving both the wrapping and low-temperature offset occurring in use of a high-speed machine and the development stability in long-term use, a toner containing at least a binder resin, a colorant, a release agent, and a crystalline polyester, in which the release agent contains a hexafunctional or higher functional alkylcarboxylate ester as a major component, and the toner contains insoluble in tetrahydrofuran (THF) component derived from the binder resin formed through Soxhlet extraction of the toner with THF of 5.0% by mass or more and 50.0% by mass or less.

PTL 2 describes, as a means for solving a problem of preventing the low-temperature offset and achieving both the low-temperature fusing property and the heat resistant storage stability, a toner containing toner particles having a core-shell structure containing a core containing a binder resin A, a colorant, and wax, having formed thereon a shell phase containing a resin B, in which the binder resin A and the binder resin B satisfy the particular characteristics in flow characteristic measurement.

PTL 1: JP 2010-145550 A

PTL 2: JP 2014-32232 A

SUMMARY OF THE INVENTION

The present invention relates to a process for producing a toner for electrophotography, including:

step 1: melt-mixing a mixture containing a crystalline resin (C) and ester wax (W) having a dipentaerythritol unit as a constitutional component, wherein a difference $|C_{mp}-W_{mp}|$ between a melting point $C_{mp}$ of the crystalline resin (C) and a melting point $W_{mp}$ of the ester wax (W) is 30° C. or less, and the melt-mixing is performed at a temperature $K_t$ that is the melting point $C_{mp}$ or more and the melting point $W_{mp}$ or more.

DETAILED DESCRIPTION OF THE INVENTION

Ester wax tends to show better dispersibility in a binder resin than such wax as hydrocarbon wax and the like. However, it has been generally known that all kinds of wax including ester wax are deteriorated in storage stability with the increase of the amount thereof blended.

PTL 1 uses ester wax having dipentaerythritol as a constitutional component. Although the wax is better than ordinary ester wax, however, there remains room of improvement for storage stability. In particular, when a crystalline resin is added to the binder resin in order to obtain a toner for electrophotography excellent in low-temperature fusing property, the toner for electrophotography has problems in initial image quality after storage, in which after storing the toner in a cartridge for a certain period of time, unevenness is observed in image quality printed in the initial stage; and in document offset property, in which the toner on a print adheres to another print. Accordingly, even though ester wax is used, it is difficult to resolve simultaneously the low-temperature fusing property, the initial image quality after storage, and the document, offset property.

The present invention relates to a process for producing a toner for electrophotography that is excellent in the low-temperature fusing property, the initial image quality after storage, and the document offset property.

As a result of earnest investigations made by the present inventors, it has been found out that the problems can be solved by a production process, in which melting points of ester wax having a dipentaerythritol unit as a constitutional component and a crystalline resin satisfy the particular relationship, and the process includes melt-mixing the components at the particular temperature.

The present invention relates to a process for producing a toner for electrophotography, including:

step 1: melt-mixing a mixture containing a crystalline resin (C) and ester wax (W) having a dipentaerythritol unit as a constitutional component, wherein a difference $|C_{mp}-W_{mp}|$ between a melting point $C_{mp}$ of the crystalline resin (C) and a melting point $W_{mp}$ of the ester wax (W) is 30° C. or less, and the melt-mixing is performed at a temperature $K_t$ that is the melting point $C_{mp}$ or more and the melting point $W_{mp}$ or more.

According to the production process of the present invention, a toner for electrophotography that is excellent in the low-temperature fusing property, the initial image quality after storage, and the document offset property can be provided.

[Production Process]

The process for producing a toner for electrophotography of the present invention includes:

step 1: melt-mixing a mixture containing a crystalline resin (C) and ester wax (W) having a dipentaerythritol unit as a constitutional component.

In the production process of the present invention, the difference $|C_{mp}-W_{mp}|$ between the Melting point $C_{mp}$ of the crystalline resin (C) and the melting point $W_{mp}$ of the ester wax (W) is 30° C. or less, and the melt-mixing is performed at a temperature $K_t$ that is the melting point $C_{mp}$ or more and the melting point $W_{mp}$ or more.

According to the production process of the present invention, a toner for electrophotography that is excellent in the low-temperature fusing property, the initial image quality after storage, and the document offset property can be obtained.

The mechanism of the effects of the present invention achieved is unclear, but can be regarded as follows.

When a crystalline resin is used in a toner for electrophotography, the problems may occur in the standpoint of the initial image quality after storage and the document offset property, since the dispersibility of the wax in the binder resin get to be insufficient in some cases due to hindering crystallization by the coexistence of wax.

In the present invention, the difference between the melting point $C_{mp}$ of the crystalline resin (C) and the melting point $W_{mp}$ of the ester wax (W) is regulated to the prescribed range or less, thereby designating the combination of a crystalline resin and ester wax having melting points that are close to each other. Furthermore, the melt-mixing is performed at a temperature $K_t$ that is the melting point $C_{mp}$ or more and the melting point $W_{mp}$ or more, thereby retaining the crystalline resin (C) and the ester wax (W) in a melting state. It is expected that according to the procedure, the crystalline resin (C) and the ester wax (W) have interaction in the process of decreasing the temperature of the composition after the melt-mixing, and the crystalline resin (C) and the ester wax (W) are crystallized at similar temperatures to provide high dispersibility, thereby consequently providing the effects of the present invention.

<Step 1>

In the step 1, a mixture containing a crystalline resin (C) and ester wax (W) having a dipentaerythritol unit as a constitutional component are melt-mixed from the standpoint of providing a toner for electrophotography excellent in the low-temperature fusing property, the initial image quality after storage, and the document offset property.

[Difference $|C_{mp}-W_{mp}|$ ]

The difference $|C_{mp}-W_{mp}|$ between the melting point $C_{mp}$ of the crystalline resin (C) and the melting point $W_{mp}$ of the ester wax (W) is 30° C. or less from the standpoint of providing a toner for electrophotography excellent in the low-temperature fusing property, the initial image quality after storage, and the document offset property. The difference $|C_{mp}-W_{mp}|$ means an absolute value of a difference between the melting point $C_{mp}$ and the melting point $W_{mp}$.

The difference $|C_{mp}-W_{mp}|$ is preferably 25° C. or less, more preferably 20° C. or less, further preferably 15° C. or less, further preferably 10° C. or less, further preferably 7° C. or less, and further preferably 3° C. or less, and may be 0° C. or more, from the standpoint of providing a toner for electrophotography excellent in the low-temperature fusing property, the initial image quality after storage, and the document offset property.

The difference $(C_{mp}-W_{mp})$ between $C_{mp}$ and $W_{mp}$ is preferably 25° C. or less, more preferably 20° C. or less, further preferably 15° C. or less, further preferably 10° C. or less, further preferably 7° C. or less, and further preferably 3° C. or less, and may be 0° C. or more, from the standpoint of enhancing the low-temperature fusing property, the initial image quality after storage, and the document offset property.

In the present invention, the melting point $C_{mp}$ and the melting point $W_{mp}$ may be measured in the method described in the examples.

[Temperature $K_t$]

The melt-mixing is performed at a temperature $K_t$ that is the melting point $C_{mp}$ or more and the melting point $W_{mp}$ or more from the standpoint of providing a toner for electrophotography excellent in the low-temperature fusing property, the initial image quality after storage, and the document offset property.

The difference $(K_t-C_{mp})$ between $K_t$ and $C_{mp}$ is preferably 10° C. or more, more preferably 15° C. or more, further preferably 20° C. or more, further preferably 25° C. or more, further preferably 30° C. or more, and further preferably 35° C. or more, from the standpoint of enhancing the low-temperature fusing property, the initial image quality after storage, and the document offset property, and is preferably 70° C. or less, more preferably 60° C. or less, further preferably 50° C. or less, and further preferably 45° C. or less, from the same standpoint.

The difference $(K_t-W_{mp})$ between $K_t$ and $W_{mp}$ is preferably 10° C. or more, more preferably 15° C. or more, further preferably 20° C. or more, further preferably 25° C. or more, further preferably 30° C. or more, and further preferably 35° C. or more, from the standpoint of enhancing the low-temperature fusing property, the initial image quality after storage, and the document offset property, and is preferably 80° C. or less, more preferably 70° C. or less, further preferably 60° C. or less, further preferably 50° C. or less, and further preferably 45° C. or less, from the same standpoint.

In the present invention, when a melt-kneader is used, the temperature $K_t$ is designated as a value obtained by measuring the temperature of the kneaded material at the outlet port of the melt-kneader with a non-contact thermometer.

[Binder Resin]

The mixture in the step 1 contains a binder resin containing a crystalline resin (C) (which may be hereinafter referred simply to a "resin (C)"). The binder resin may contain another resin, and for example, may contain an amorphous resin (A) described later.

<Crystalline Resin (C)>

The "crystalline resin" means a resin that has a value of a crystallinity index, which is defined by the ratio of the softening point (° C.) with respect to the maximum endothermic peak temperature (° C.) with a differential scanning calorimeter (DSC), i.e., ((softening point)/(maximum endothermic peak temperature)), of 0.6 or more and less than 1.4, and preferably 0.8 or more and 1.2 or less. The maximum endothermic peak temperature means the temperature of the peak that has the highest temperature among the endothermic peaks observed under the condition of the measurement method described in the examples. The maximum peak temperature that has a difference of 20° C. or less from the softening point is designated as the melting point of the crystalline resin, and the peak having a difference exceeding 20° C. from the softening point is designated as the peak derived from the glass transition of the amorphous resin.

The resin C preferably contains a resin having at least a polyester moiety that is a polycondensate of an alcohol component and a carboxylic acid component.

The resin C may include a polyester, and a composite resin having a polyester segment.

The resin C is preferably at least one selected from a polyester, and a composite resin having a polyester segment and a styrene resin segment.

(Alcohol Component)

Examples of the alcohol component include an aromatic polyol compound and an aliphatic polyol compound, and the alcohol component preferably contains an aliphatic polyol compound from the standpoint of enhancing the low-temperature fusing property, the initial image quality after storage, and the document offset property.

Examples of the aliphatic polyol compound include an aliphatic diol having a number of carbon atoms of 2 or more and 20 or less, and a trihydric or higher aliphatic alcohol, such as glycerin. Among these, an aliphatic diol is preferred.

The number of carbon atoms of the aliphatic diol is preferably 2 or more, more preferably 4 or more, further preferably 6 or more, further preferably 9 or more, and further preferably 11 or more, and is preferably 20 or less, more preferably 16 or less, and further preferably 14 or less, from the standpoint of enhancing the low-temperature fusing property, the initial image quality after storage, and the document offset property.

Examples of the aliphatic diol include ethylene glycol, 1,2-propanediol, 1,3-propanediol, 1,4-butanediol, 1,5-pentanediol, 1,6-hexanediol, 1,4-butenediol, 1,3-butanediol, neopentyl glycol, 1,10-decanediol, and 1,12-dodecanediol.

Among these, the aliphatic diol is preferably at least one selected from 1,4-butanediol, 1,6-hexanediol, 1,10-decanediol, and 1,12-dodecanediol, and more preferably at least one selected from 1,10-decanediol and 1,12-dodecanediol.

The content of the aliphatic diol is preferably 70% by mol or more, more preferably 90% by mol or more, further preferably 95% by mol or more, and further preferably 100% by mol, based on the alcohol component.

(Carboxylic Acid Component)

An aromatic dicarboxylic acid is preferable as the carboxylic acid component from the standpoint of the initial image quality after storage. An aliphatic dicarboxylic acid is preferable from the standpoint of the low-temperature fusing property.

Examples of the aromatic dicarboxylic acid include phthalic acid, isophthalic acid, and terephthalic acid; and anhydrides of these acids and alkyl (having a number of carbon atoms of 1 or more and 3 or less) esters of these acids, and among these, terephthalic acid or isophthalic acid is preferred, and terephthalic acid is more preferred. One kind or two or more kinds thereof may be used. In the present invention, the carboxylic acid component includes not only a free acid but also an anhydride and an ester with an alkyl having a number of carbon atoms of 1 or more and 3 or less, forming an acid through decomposition during reaction.

The content of the aromatic dicarboxylic acid is preferably 10% by mol or more, more preferably 30% by mol or more, and further preferably 50% by mol or more, and may be 100% by mol or less, based on the carboxylic acid component.

The number of carbon atoms of the aliphatic dicarboxylic acid is preferably 2 or more, more preferably 6 or more, further preferably 9 or more, and further preferably 10 or more, and is preferably 26 or less, more preferably 20 or less, further preferably 16 or less, and further preferably 14 or less, from the standpoint of enhancing the low-temperature fusing property, the initial image quality after storage, and the document offset property.

Examples of the aliphatic dicarboxylic acid include an aliphatic dicarboxylic acid, such as oxalic acid, malonic acid, maleic acid, fumaric acid, sebacic acid, citraconic acid, itaconic acid, glutaconic acid, succinic acid, adipic acid, and succinic acid substituted with an alkyl group having a number of carbon atoms of 1 or more and 20 or less or an alkenyl group having a number of carbon atoms of 2 or more and 20 or less, such as dodecenylsuccinic acid and octylsuccinic acid; and anhydrides of these acids and alkyl (having a number of carbon atoms of 1 or more and 3 or less) esters of these acids, and among these, sebacic acid and fumaric acid are preferable, and sebacic acid is more preferable. One kind or two or more kinds thereof may be used.

The content of the aliphatic dicarboxylic acid is preferably 10% by mol or more, more preferably 20% by mol or more, further preferably 40% by mol or more, further preferably 60% by mol or more, and further preferably 80% by mol or more, and may be 100% by mol or less from the standpoint of the low-temperature fusing property, based on the carboxylic acid component.

The carboxylic acid component may preferably contain a tribasic or higher carboxylic acid from the standpoint of the productivity.

A monohydric alcohol may be contained in the alcohol component, and a monobasic carboxylic acid may be contained in the carboxylic acid component, appropriately from the standpoint of the control of the molecular weight.

The crystalline resin (C) is preferably a resin having at least an ester moiety that is a polycondensate of an alcohol component containing an aliphatic diol having a number of carbon atoms of 9 or more and 14 or less and a carboxylic acid component containing an aliphatic dicarboxylic acid compound having a number of carbon atoms of 9 or more and 14 or less.

The equivalent ratio (COOH group/OH group) of the carboxylic acid component and the alcohol component is preferably 0.7 or more, and more preferably 0.8 or more, and is preferably 1.3 or less, and more preferably 1.2 or less, from the standpoint of controlling the end group.

The polycondensation of the alcohol component and the carboxylic acid component may be performed, for example, in an inert gas atmosphere, in the presence of an esterification catalyst, a polymerization inhibitor, or the like depending on necessity, at a temperature of approximately 180° C. or more and 250° C. or less. Examples of the esterification catalyst include a tin compound, such as dibutyltin oxide and tin(II) 2-ethylhexanoate, and a titanium compound, such as titanium diisopropylate bistriethanolaminate. Examples of an esterification promoter used with the esterification catalyst include gallic acid. The amount of the esterification catalyst used is preferably 0.01 part by mass or more, and more preferably 0.1 part by mass or more, and is preferably 1 parts by mass or less, and more preferably 0.6 part by mass or less, per 100 parts by mass of the total amount of the alcohol component and the carboxylic acid component. The amount of the esterification promoter used is preferably 0.001 part by mass or more, and more preferably 0.01 part by mass or more, and is preferably 0.5 part by mass or less, and more preferably 0.1 part by mass or less, per 100 parts by mass of the total amount of the alcohol component and the carboxylic acid component.

[Composite Resin]

The composite resin preferably has a polyester segment and a styrene resin segment.

The polyester segment may be formed of a polyester, and preferred examples of the polyester include the same ones described above for the polyester.

(Styrene Resin Segment)

The styrene resin segment may be formed of a styrene resin, and the styrene resin is preferably an addition polymer of a raw material monomer containing a styrene compound.

Examples of the styrene compound include styrene and a styrene derivative, such as α-methylstyrene and vinyltoluene (and in the following description, styrene and a styrene derivative are collectively referred to as a "styrene compound").

The content of the styrene compound is preferably 50% by mass or more, more preferably 60% by mass or more, further preferably 70% by mass or more, and further preferably 75% by mass or more, and may be 100% by mass or less, based on the raw material monomer of the styrene resin, from the standpoint of the durability.

Examples of the raw material monomer of the styrene resin other than the styrene compound include an alkyl (meth)acrylate ester; an ethylenic unsaturated monoolefin compound, such as ethylene and propylene; a diolefin compound, such as butadiene; a halogenated vinyl compound, such as vinyl chloride; a vinyl ester compound, such as vinyl acetate and vinyl propionate; a vinyl ether compound, such as vinyl methyl ether; a vinylidene halide compound, such as vinylidene chloride; and an N-vinyl compound, such as N-vinylpyrrolidone.

Two or more kinds of the raw material monomer of the styrene resin other than the styrene compound may be used. In the description herein, the "(meth)acrylic acid" means at least one selected from acrylic acid and methacrylic acid.

The raw material monomer of the styrene resin other than the styrene compound is preferably an alkyl (meth)acrylate ester from the standpoint of enhancing the low-temperature fusing property of the toner. The number of carbon atoms of the alkyl group in the alkyl (meth)acrylate ester is preferably 1 or more, more preferably 2 or more, and further preferably 3 or more, and is preferably 22 or less, more preferably 18 or less, further preferably 12 or less, and further preferably 8 or less, from the aforementioned standpoint. The number of carbon atoms of the alkyl ester means the number of carbon atoms derived from the alcohol component constituting the ester.

Specific examples of the alkyl (meth)acrylate ester include methyl (meth)acrylate, ethyl (meth)acrylate, (iso) propyl (meth)acrylate, 2-hydroxyethyl (meth)acrylate, (iso- or tert-)butyl (meth)acrylate, 2-ethylhexyl (meth)acrylate, (iso)octyl (meth)acrylate, (iso)decyl (meth)acrylate, and (iso)stearyl (meth)acrylate. The expressions "(iso- or tert-)" and "(iso)" herein each means both the case where the prefix exists and the case where the prefix does not exist, and the case where the prefix does not exist shows the normal. The "(meth)acrylate" means at least one selected from an acrylate and a methacrylate.

The content of the alkyl (meth)acrylate ester is preferably 50% by mass or less, more preferably 40% by mass or less, further preferably 30% by mass or less, and further preferably 25% by mass or less, and is preferably 0% by mass or more, based on the raw material monomer of the styrene resin segment, from the standpoint of the low-temperature fusing property.

The resin obtained through addition polymerization of the raw material monomer containing the styrene compound and the alkyl (meth)acrylate ester may also be referred to as a styrene-(meth)acrylate resin.

The addition polymerization reaction of the raw material monomer of the styrene resin may be performed, for example, by an ordinary method in the presence of a polymerization initiator, such as dicumyl peroxide, a cross-linking agent, and the like, in the presence of an organic solvent or without a solvent, and the temperature condition is preferably 110° C. or more, more preferably 120° C. or more, and further preferably 130° C. or more, and is preferably 250° C. or less, more preferably 200° C. or less, and further preferably 170° C. or less.

In the case where an organic solvent is used in the addition polymerization reaction, xylene, toluene, methyl ethyl ketone, acetone, and the like may be used. The amount of the organic solvent used is preferably 10 parts by mass or more and 50 parts by mass or less per 100 parts by mass of the raw material monomer of the styrene resin.

(Bireactive Monomer)

The composite resin is preferably a composite resin that is obtained by further using a bireactive monomer capable of reacting with both the raw material monomer of the polyester segment and the raw material monomer of the styrene resin segment, in addition to the raw material monomer of the polyester segment and the raw material monomer of the styrene resin segment, from the standpoint of enhancing the low-temperature fusing property, the initial image quality after storage, and the document offset property. Accordingly, in the production of the composite resin through polymerization of the raw material monomer of the polyester segment and the raw material monomer of the styrene resin segment, the polycondensation reaction and/or the addition polymerization reaction are preferably performed in the presence of the bireactive monomer. According to the procedure, the composite resin becomes such a composite resin that the polyester segment and the styrene resin segment are bonded to each other through the constitutional unit derived from the bireactive monomer, and the polyester segment and the styrene resin segment are dispersed finely and uniformly.

Accordingly, the composite resin is preferably a resin obtained through polymerization of (i) the raw material monomer of the polyester segment containing an alcohol component containing an aliphatic polyol compound, and a carboxylic acid component, (ii) the raw material monomer of the styrene resin segment, and (iii) the bireactive monomer capable of reacting with both the raw material monomer of the polyester segment and the raw material monomer of the styrene resin segment from the standpoint of enhancing the low-temperature fusing property, the initial image quality after storage, and the document offset property.

The bireactive monomer may be a compound that has in the molecule thereof at least one functional group selected from the group consisting of a hydroxy group, a carboxy group, an epoxy group, a primary amino group, and a secondary amino group, preferably at least one functional group selected from the group consisting of a hydroxy group and a carboxy group, and more preferably a carboxy group and an ethylenic unsaturated bond, and the use of the bireactive monomer may enhance the dispersibility of the resin as the dispersed state. The bireactive monomer is preferably at least one selected from the group consisting of acrylic acid, methacrylic acid, fumaric acid, maleic acid, and maleic anhydride, and is more preferably acrylic acid, methacrylic acid, or fumaric acid, and further preferably acrylic acid or methacrylic acid, from the standpoint of the reactivity of the polycondensation reaction and the addition polymerization reaction. In the use thereof with a polymerization inhibitor, a polybasic carboxylic acid having an ethylenic unsaturated bond, such as fumaric acid, functions as a raw material monomer of the polyester segment. In this case, fumaric acid or the like is not the bireactive monomer but is a raw material monomer of the polyester segment.

The amount of the bireactive monomer used is preferably 1 part by mol or more, more preferably 2 parts by mol or more, and further preferably 3 parts by mol or more, from the standpoint of the low-temperature fusing property, and is preferably 20 parts by mol or less, more preferably 10 parts by mol or less, and further preferably 7 parts by mol or less, from the standpoint of the initial image quality after storage of the toner and the document offset property, per 100 parts by mol of the alcohol component of the polyester segment.

The mass ratio (polyester segment/styrene resin segment) of the polyester segment and the styrene resin segment in the composite resin is preferably 60/40 or more, more preferably 70/30 or more, and further preferably 75/25 or more, from the standpoint of the low-temperature fusing property, and is preferably 95/5 or less, more preferably 90/10 or less, and further preferably 85/15 or less, from the standpoint of the initial image quality after storage and the document offset property. In the aforementioned calculation, the mass of the polyester segment is the amount obtained by subtracting the amount (calculated amount) of water eliminated in the polycondensation reaction from the mass of the raw material monomer of the polycondensation resin used, and the amount of the bireactive monomer is included in the amount of the raw material monomer of the polyester segment. The amount of the styrene resin segment is the amount of the raw material monomer of the styrene resin segment, and the amount of the polymerization initiator is included in the amount of the raw material monomer of the styrene resin segment.

[Properties and Content of Resin C]

The melting point $C_{mp}$ of the resin C is preferably 65° C. or more, more preferably 70° C. or more, further preferably 75° C. or more, and further preferably 80° C. or more, from the standpoint of the low-temperature fusing property, and is preferably 150° C. or less, more preferably 135° C. or less, and further preferably 120° C. or less, from the same standpoint.

The softening point of the resin C is preferably 75° C. or more, more preferably 80° C. or more, and further preferably 85° C. or more, from the standpoint of the low-temperature fusing property, and is preferably 150° C. or less, more preferably 135° C. or less, and further preferably 120° C. or less, from the same standpoint.

The acid value of the resin C is preferably 40 mgKOH/g or less, more preferably 30 mgKOH/g or less, and further preferably 20 mgKOH/g or less, from the standpoint of enhancing the initial image quality after storage of the toner, and is preferably 1 mgKOH/g or more, and more preferably 2 mgKOH/g or more.

The content of the resin C in the mixture is preferably 1% by mass or more, more preferably 2% by mass or more, further preferably 3% by mass or more, and further preferably 4% by mass or more, from the standpoint of the low-temperature fusing property, and is preferably 30% by mass or less, more preferably 20% by mass or less, further preferably 15% by mass or less, and further preferably 12% by mass or less, from the standpoint of enhancing the low-temperature fusing property, the initial image quality after storage, and the document offset property, based on the total amount of the resin C and the amorphous resin (A) (which may be hereinafter referred simply to as a "resin A").

The content of the resin C in the mixture is preferably 1% by mass or more, more preferably 2% by mass or more, further preferably 3% by mass or more, and further preferably 4% by mass or more, from the standpoint of the low-temperature fusing property, and is preferably 30% by mass or less, more preferably 20% by mass or less, further preferably 15% by mass or less, and further preferably 12% by mass or less, from the standpoint of enhancing the low-temperature fusing property, the initial image quality after storage, and the document offset property, based on the total amount of the mixture.

<Amorphous Resin (A)>

The toner of the present invention preferably contains a resin A as a binder resin.

In the present invention, the "amorphous resin" means a resin that has a value of the aforementioned crystallinity index, which is defined by the ratio of the softening point (° C.) with respect to the maximum endothermic peak temperature (° C.) with a differential scanning calorimeter (DSC), i.e., ((softening point)/(maximum endothermic peak temperature)), of 1.4 or more or less than 0.6. The maximum endothermic peak temperature means the temperature of the peak that has the highest temperature among the endothermic peaks observed under the condition of the measurement method described in the examples.

The resin A preferably has at least a polyester moiety obtained through polycondensation of an alcohol component and a carboxylic acid component.

The resin A may include a polyester, and a composite resin having a polyester segment.

The resin A is preferably at least one selected from a polyester, and a composite resin having a polyester segment and a styrene resin segment.

As for preferred embodiments of the resin A shown below, descriptions for the matters that are common to the examples for the resin C are omitted, and only preferred embodiments for the embodiments of the resin A are described.

(Alcohol Component)

The alcohol component of the resin A preferably contains an aromatic polyol compound.

The aromatic polyol compound is preferably an alkylene oxide adduct of bisphenol A, and more preferably an alkylene oxide adduct of bisphenol A represented by the formula (I):

(I)

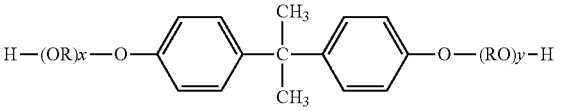

wherein RO and OR each represent an oxyalkylene group; R represents at least one selected from an ethylene group and a propylene group; and x and y represent average numbers of moles added of the alkylene oxides, and each represent a positive number, the sum of x and y is 1 or more, and preferably 1.5 or more, and is 16 or less, preferably 8 or less, and more preferably 4 or less.

Examples of the alkylene oxide adduct of bisphenol A represented by the formula (I) include a propylene oxide adduct of 2,2-bis(4-hydroxyphenyl)propane and an ethylene oxide adduct of 2,2-bis(4-hydroxyphenyl)propane. One kind or two or more kinds thereof are preferably used.

The content of the alkylene oxide adduct of bisphenol A represented by the formula (I) is preferably 70% by mol or more, more preferably 90% by mol or more, further preferably 95% by mol or more, and further preferably 100% by mol, based on the alcohol component.

(Carboxylic Acid Component)

The carboxylic acid component of the resin A preferably contains an aromatic dicarboxylic acid, and may further contain an aliphatic dicarboxylic acid in addition to the aromatic dicarboxylic acid, from the standpoint of the initial image quality after storage and the document offset property.

The content of the aromatic dicarboxylic acid is preferably 40% by mol or more, more preferably 50% by mol or more, and further preferably 70% by mol or more, and may be preferably 100% by mol or less, based on the carboxylic acid component.

The aliphatic dicarboxylic acid is preferably an aliphatic dicarboxylic acid, such as succinic acid substituted with an alkyl group having a number of carbon atoms of 1 or more and 20 or less or an alkenyl group having a number of carbon atoms of 2 or more and 20 or less, or adipic acid, and more preferably dodecenylsuccinic acid or adipic acid.

The content of the aliphatic dicarboxylic acid is preferably 3% by mol or more, more preferably 8% by mol or more, and further preferably 10% by mol or more, and is preferably 40% by mol or less, more preferably 30% by mol or less, and further preferably 25% by mol or less, based on the carboxylic acid component.

The carboxylic acid component preferably contains a tribasic or higher carboxylic acid, and more preferably contains a tribasic carboxylic acid, from the standpoint of the initial image quality after storage and the document offset property.

Examples of the tribasic or higher carboxylic acid include 1,2,4-benzenetricarboxylic acid (trimellitic acid), 2,5,7-naphthalenetricarboxylic acid, pyromellitic acid, anhydrides of these acids, and lower alkyl (having a number of carbon atoms of 1 or more and 3 or less) esters of these acids, and among these, trimellitic acid or trimellitic anhydride is preferred.

The content of the tribasic or higher carboxylic acid, preferably the content of trimellitic acid or trimellitic anhydride, is preferably 1% by mol or more, more preferably 3% by mol or more, and further preferably 5% by mol or more, and is preferably 30% by mol or less, more preferably 20% by mol or less, and further preferably 15% by mol or less, from the standpoint of the low-temperature fusing property.

[Composite Resin]

The composite resin as the resin A preferably has a polyester segment and a styrene resin segment. The polyester segment is formed of a polyester, and preferred examples of the polyester include the same ones described above for the polyester of the resin A.

(Styrene Resin Segment)

The content of the styrene compound is preferably 50% by mass or more, more preferably 60% by mass or more, further preferably 70% by mass or more, and further preferably 75% by mass or more, and is preferably 95% by mass or less, more preferably 90% by mass or less, and further preferably 87% by mass or less, from the standpoint of the low-temperature fusing property, based on the raw material monomer of the styrene resin.

The content of the alkyl (meth)acrylate ester is preferably 5% by mass or more, more preferably 10% by mass or more, and further preferably 13% by mass or more, from the standpoint of the low-temperature fusing property, and is preferably 50% by mass or less, more preferably 40% by mass or less, further preferably 30% by mass or less, and further preferably 25% by mass or less, from the same standpoint, based on the raw material monomer of the styrene resin segment.

[Properties and Content of Resin A]

The glass transition temperature of the resin A is preferably 45° C. or more, more preferably 50° C. or more, and further preferably 55° C. or more, from the standpoint of enhancing the initial image quality after storage, and is preferably 80° C. or less, more preferably 75° C. or less, further preferably 70° C. or less, and further preferably 65° C. or less, from the standpoint of enhancing the low-temperature fusing property of the toner.

The softening point of the resin A is preferably 80° C. or more, more preferably 95° C. or more, and further preferably 100° C. or more, from the standpoint of the low-temperature fusing property, and is preferably 160° C. or less, more preferably 150° C. or less, and further preferably 140° C. or less, from the same standpoint.

The acid value of the resin A is preferably 40 mgKOH/g or less, more preferably 30 mgKOH/g or less, and further preferably 20 mgKOH/g or less, from the standpoint of enhancing the initial image quality after storage, and is preferably 1 mgKOH/g or more, and more preferably 2 mgKOH/g or more.

The content of the resin A in the mixture is preferably 70% by mass or more, more preferably 80% by mass or more, and further preferably 90% by mass or more, from the standpoint of enhancing the low-temperature fusing property, the initial image quality after storage, and the document offset property, and is preferably 99% by mass or less, more preferably 98% by mass or less, further preferably 97% by mass or less, and further preferably 96% by mass or less, from the standpoint of the low-temperature fusing property, based on the total amount of the resin C and the resin A.

The content of the resin A in the mixture is preferably 40% by mass or more, more preferably 50% by mass or more, further preferably 60% by mass or more, further preferably 70% by mass or more, and further preferably 80% by mass or more, from the standpoint of enhancing the low-temperature fusing property, the initial image quality after storage, and the document offset property, and is preferably 99% by mass or less, more preferably 96% by mass or less, further preferably 93% by mass or less, and further preferably 90% by mass or less, from the standpoint of the low-temperature fusing property, based on the total amount of the mixture.

[Ester Wax (W)]

The ester wax (W) has a dipentaerythritol unit as a constitutional component from the standpoint of providing a toner for electrophotography excellent in the low-temperature fusing property, the initial image quality after storage, and the document offset property.

The ester wax (W) is preferably a fatty acid ester of dipentaerythritol from the standpoint of providing a toner for electrophotography excellent in the low-temperature fusing property, the initial image quality after storage, and the document offset property.

In the ester wax (W), the ester substitution number of a fatty acid on dipentaerythritol is preferably 4 or more, and more preferably 5 or more, and is 6 or less, from the standpoint of providing a toner for electrophotography excellent in the low-temperature fusing property, the initial image quality after storage, and the document offset property.

The fatty acid as a constitutional component of the ester wax (W) may be a straight-chain fatty acid or a branched chain fatty acid, and is preferably a straight-chain fatty acid. Accordingly, the ester wax (W) may be a straight-chain fatty acid ester of dipentaerythritol.

The number of carbon atoms of the fatty acid as a constitutional component of the ester wax (W) is preferably 8 or more, more preferably 10 or more, further preferably 12 or more, and further preferably 14 or more, and is preferably 30 or less, more preferably 26 or less, further preferably 24 or less, and further preferably 20 or less.

Examples of the fatty acid, as a constitutional component of the ester wax (W), include octanoic acid, decanoic acid, lauric acid, myristic acid, palmitic acid, stearic acid, oleic acid, icosanoic acid, and tetracosanoic acid. One kind or two or more kinds thereof may be used. Among these, at least one selected from lauric acid, myristic acid, palmitic acid, and stearic acid is preferable, at least one selected from myristic acid, palmitic acid, and stearic acid is more preferable, and stearic acid is further preferable.

The melting point $W_{mp}$ of the ester wax (W) is preferably 60° C. or more, more preferably 65° C. or more, and further preferably 70° C. or more, from the standpoint of the low-temperature fusing property, and is preferably 150° C. or less, more preferably 135° C. or less, further preferably 120° C. or less, and further preferably 100° C. or less, from the same standpoint.

The hydroxyl value of the ester wax (W) is preferably 0.01 mgKOH/g or more, more preferably 0.05 mgKOH/g or more, and further preferably 0.1 mgKOH/g or more, from the standpoint of the low-temperature fusing property, and is preferably 3 mgKOH/g or less, more preferably 2 mgKOH/g or less, further preferably 1 mgKOH/g or less, and further preferably 0.5 mgKOH/g or less, from the same standpoint.

The hydroxyl value of the ester wax (W) may be measured by the method described in the examples.

The content of the ester wax (W) in the mixture is preferably 0.5 part by mass or more, inure preferably 1 part by mass or more, further preferably 2 parts by mass or more, and further preferably 3 parts by mass or more, from the standpoint of the low-temperature fusing property, and is preferably 30 parts by mass or less, more preferably 20 parts by mass or less, further preferably 15 parts by mass or less, further preferably 12 parts by mass or less, further preferably 7 parts by mass or less, and further preferably 4 parts by mass or less, from the standpoint of enhancing the low-temperature fusing property, the initial image quality after storage, and the document offset property, per 100 parts by mass of the total amount of the crystalline resin (C) and the amorphous resin (A).

The content of the ester wax (W) in the mixture is preferably 0.4% by mass or more, more preferably 0.8% by mass or more, further preferably 2% by mass or more, and further preferably 2.5% by mass or more, from the standpoint of the low-temperature fusing property, and is preferably 30% by mass or less, more preferably 20% by mass or less, further preferably 15% by mass or less, further preferably 12% by mass or less, further preferably 7% by mass or less, and further preferably 4% by mass or less, from the standpoint of enhancing the low-temperature fusing property, the initial image quality after storage, and the document offset property, based on the total amount of the mixture.

[Additional Release Agent]

The mixture in the step 1 may contain a release agent in addition to the ester wax (W) in such a range that does not impair the effects of the present invention.

Examples of the release agent include polypropylene wax, polyethylene wax, and polypropylene-polyethylene copolymer wax; hydrocarbon wax, such as microcrystalline wax, paraffin wax, Fischer-Tropsch wax, and Sasol wax, and oxides thereof; ester wax, such as carnauba wax and montan wax, and deoxidized wax thereof, and fatty acid ester wax; a fatty acid amide compound, a fatty acid compound, a higher alcohol compound, and a fatty acid metal salt, and one kind or two or more kinds thereof may be used.

The melting point of the release agent is preferably 60° C. or more, and more preferably 70° C. or more, from the standpoint of the initial image quality after storage of the toner, and is preferably 160° C. or less, more preferably 150° C. or less, and further preferably 140° C. or less, from the standpoint of the low-temperature fusing property.

The content of the additional release agent is preferably 10 parts by mass or less, more preferably 5 parts by mass or less, and further preferably 3 parts by mass or less, and is preferably 0.01 part by mass or more, per 100 parts by mass of the binder resin, from the standpoint of the dispersibility in the binder resin.

[Charge Controlling Agent]

The mixture in the step 1 may contain a charge controlling agent.

The charge controlling agent is not particularly limited, and any of a positive charge controlling agent and a negative charge controlling agent may be contained.

Examples of the positive charge controlling agent include a nigrosine dye, such as "Nigrosine Base EX", "Oil Black BS", "Oil Black SO", "Bontron N-01", "Bontron N-04", "Bontron N-07", "Bontron N-09", and "Bontron N-11" (all produced by Orient Chemical Industries, Co., Ltd.); a triphenylmethane dye having a tertiary amine as a side chain, a quaternary ammonium salt compound, such as "Bontron P-51" (produced by Orient Chemical Industries, Co., Ltd.), cetyltrimethylammonium bromide, "Copy Charge PX VP435" (produced by Clariant AG); a polyamine resin, such as "AFP-B" (produced by Orient Chemical Industries, Co., Ltd.); an imidazole derivative, such as "PLZ-2001" and "PLZ-8001" (all produced by Shikoku Chemicals Corporation); and a styrene-acrylic resin, such as "FCA-701PT" (produced by Fujikura Kasei Co., Ltd.).

Examples of the negative charge controlling agent include a metal-containing azo dye, such as "Valifast Black 3804", "Bontron S-31", "Bontron S-32", "Bontron S-34", and "Bontron S-36" (all produced by Orient Chemical Industries, Co., Ltd.), and "Aizen Spilon Black TRH" and "T-77" (all produced by Hodogaya Chemical Co., Ltd.); a metal compound of a benzilic acid, such as "LR-147" and "LR-297" (all produced by Japan Carlit Co., Ltd.), a metal compound of a salicylic acid compound, such as "Bontron E-81", "Bontron E-84", "Bontron E-88", and "Bontron E-304" (all produced by Orient Chemical Industries, Co., Ltd.), and "TN-105" (produced by Hodogaya Chemical Co., Ltd.); a copper phthalocyanine dye; a quaternary ammonium salt, such as "Copy Charge NX VP434" (produced by Clariant AG), a nitroimidazole derivative; and an organic metal compound.

Among the charge controlling agents, a negative charge controlling agent is preferred, and a metal compound of a salicylic acid compound is more preferred.

The content of the charge controlling agent is preferably 0.01 part by mass or more, and more preferably 0.2 part by mass or more, and is preferably 10 parts by mass or less, more preferably 5 parts by mass or less, further preferably 3 parts by mass or less, and further preferably 2 parts by mass or less, per 100 parts by mass of the binder resin.

[Colorant]

The mixture in the step 1 may contain a colorant.

The colorant used may be any of dyes, pigments, and the like that have been used as a colorant for a toner, and examples thereof include carbon black, phthalocyanine blue, permanent brown FG, brilliant fast scarlet, pigment green B, rhodamine-B base, solvent red 49, solvent red 146, solvent blue 35, quinacridone, carmine 6B, and disazo yellow. The toner of the present invention may be any of a black toner and a color toner.

The content of the colorant is preferably 1 part by mass or more, and more preferably 2 parts by mass or more, and is preferably 40 parts by mass or less, more preferably 20 parts by mass or less, and further preferably 10 parts by mass or less, per 100 parts by mass of the binder resin, from the standpoint of enhancing the image density of the toner.

The mixture in the step 1 may further contain additives, such as magnetic powder, a fluidity enhancer, a conductivity controlling agent, a reinforcing filler, such as a fibrous substance, an antioxidant, an anti-aging agent, and a cleaning property enhancer.

[Melt-Mixing Conditions]

The melt-mixing in the step 1 is preferably melt-kneading with a melt-kneader from the standpoint of providing a toner for electrophotography excellent in the low-temperature fusing property, the initial image quality after storage, and the document offset property, and the standpoint of the productivity.

The melt-mixing temperature $K_t$ is not particularly limited, as far as the aforementioned condition is satisfied, is preferably 80° C. or more, more preferably 90° C. or more, and further preferably 100° C. or more, and is preferably 150° C. or less, more preferably 140° C. or less, and further preferably 130° C. or less.

The melt-mixing time is preferably 1 hour or less, more preferably 30 minutes or less, further preferably 10 minutes or less, and further preferably 5 minutes or less, and may be, for example, 1 minute or more, while depending on the scale of the kneader used.

The melt-kneading may be performed with a known kneader, such as a closed kneader, a single screw extruder, a twin screw extruder, and an open roll kneader. A twin screw extruder capable of being set to a high temperature condition is preferred from the standpoint of melt-mixing the crystals.

The raw materials of the toner including the binder resin, the colorant, the charge controlling agent, the release agent, and the like are preferably mixed in advance with a mixer, such as a Henschel mixer and a ball mill, and then subjected to the kneader.

In the twin screw extruder, the kneading part is closed, and the materials can be readily melted with kneading heat generated on kneading.

The set temperature of the twin screw extruder is not influenced by the melt characteristics of the materials due to the structure of the extruder, and the melt-mixing can be readily performed at the intended temperature.

The set temperature of the twin screw extruder (i.e., the set temperature of the barrel) may be appropriately set to make the temperature $K_t$ within the prescribed range, and for example, is preferably 65° C. or more, more preferably 80° C. or more, and further preferably 90° C. or more, and is preferably 160° C. or less, and more preferably 140° C. or less.

The rotation peripheral speed in the case using a co-rotation twin screw extruder is preferably 5 m/min or more, more preferably 10 m/min or more, and further preferably 15 to/min or more, and is preferably 50 m/min or less, more preferably 40 m/min or less, and further preferably 30 m/min or less, from the standpoint of enhancing the dispersibility of the additives, such as the colorant, the charge controlling agent, the release agent, in the toner, and the standpoint of reducing the mechanical force and suppressing the heat generation in the melt-kneading.

The melt-mixture obtained in the step 1 may be supplied to a step 2 after cooling to such an extent that the mixture can be pulverized.

<Step 2>

In the step 2, the melt-mixture obtained in the step 1 is pulverized and classified.

The pulverizing step may be performed in multiple stages. For example, a resin kneaded material obtained by curing the melt mixture may be coarsely pulverized into approximately from 1 to 5 mm, and then further finely pulverized into the desired particle diameter.

The pulverizer used in the pulverizing step is not particularly limited, and examples of the pulverizer that may be preferably used for coarse pulverization include a hummer mill, an atomizer, and Rotoplex. Examples of the pulverizer that may be preferably used for fine pulverization include a fluidized bed jet mill, a collision plate jet mill, and a rotary mechanical mill. From the standpoint of the pulverization efficiency, a fluidized bed jet mill and a collision plate jet mill are preferably used, and a collision plate jet mill is more preferably used.

Examples of the classifier used for the classifying step include a rotor classifier, an airflow classifier, an inertial classifier, and a sieve classifier. The pulverized product that is removed in the classifying step due to the insufficient pulverization may be again supplied to the pulverizing step, and the pulverizing step and the classifying step may be repeated depending on necessity.

The volume median diameter ($D_{50}$) of the powder (toner particle) obtained by the steps is preferably 2 μm or more, more preferably 3 μm or more, and further preferably 4 μm or more, and is preferably 20 μm or less, more preferably 15 μm or less, and further preferably 10 μm or less.

<Step 3>

The production process of the present invention may further include the following step 3:

step 3: mixing the powder obtained through classification in the step 2, with an external additive.

[External Additive]

Examples of the external additive include inorganic fine particles, such as hydrophobic silica, titanium oxide fine particles, alumina fine particles, cerium oxide fine particles, and carbon black, and fine particles of polymer, such as polycarbonate, polymethyl methacrylate, and a silicone resin, and among these, hydrophobic silica is preferred.

In the case where the toner particles are subjected to a surface treatment with an external additive, the amount of the external additive added is preferably 0.1 part by mass or more, more preferably 0.5 part by mass or more, and further preferably 1.0 part by mass or more, and is preferably 5 parts by mass or less, more preferably 4 parts by mass or less, and further preferably 3 parts by mass or less, per 100 parts by mass of the toner particles. Examples of the mixer used in this step include a Henschel mixer and a super mixer.

In relation to the aforementioned embodiments, the present invention further relates to the processes for producing a toner for electrophotography, and the like shown below.

<1> A process for producing a toner for electrophotography, including:

step 1: melt-mixing a mixture containing a crystalline resin (C) and ester wax (W) having a dipentaerythritol unit as a constitutional component, wherein a difference $|C_{mp}-W_{mp}|$ between a melting point $C_{mp}$ of the crystalline resin (C) and a melting point $W_{mp}$ of the ester wax (W) is 30° C. or less, and the melt-mixing is performed at a temperature $K_t$ that is the melting point $C_{mp}$ or more and the melting point $W_{mp}$ or more.

<2> The process for producing a toner for electrophotography according to the item <1>, wherein the difference $|C_{mp}-W_{mp}|$ is preferably 25° C. or less, more preferably 20° C. or less, further preferably 15° C. or less, further preferably 10° C. or less, further preferably 7° C. or less, and further preferably 3° C. or less, and may be 0° C. or more.

<3> The process for producing a toner for electrophotography according to the item <1> or <2>, wherein the difference ($C_{mp}-W_{mp}$) between $C_{mp}$ and $W_{mp}$ is preferably 25° C. or less, more preferably 20° C. or less, further preferably 15° C. or less, further preferably 10° C. or less, further preferably 7° C. or less, and further preferably 3° C. or less, and may be 0° C. or more.

<4> The process for producing a toner for electrophotography according to any one of the items <1> to <3>, wherein the difference ($K_t-C_{mp}$) between $K_t$ and $C_{mp}$ is preferably 10° C. or more, more preferably 15° C. or more, further preferably 20° C. or more, further preferably 25° C. or more, further preferably 30° C. or more, and further preferably 35° C. or more, and is preferably 70° C. or less, more preferably 60° C. or less, further preferably 50° C. or less, and further preferably 45° C. or less.

<5> The process for producing a toner for electrophotography according to any one of the items <1> to <4>, wherein the difference ($K_t-W_{mp}$) between $K_t$ and $W_{mp}$ is preferably 10° C. or more, more preferably 15° C. or more, further preferably 20° C. or more, further preferably 25° C. or more, further preferably 30° C. or more, and further preferably 35° C. or more, and is preferably 80° C. or less, more preferably 70° C. or less, further preferably 60° C. or less, further preferably 50° C. or less, and further preferably 45° C. or less.

<6> The process for producing a toner for electrophotography according to any one of the items <1> to <5>, wherein the crystalline resin (C) contains a resin having at least a polyester moiety that is a polycondensate of an alcohol component and a carboxylic acid component.

<7> The process for producing a toner for electrophotography according to the item <6>, wherein the alcohol component of the crystalline resin (C) preferably contains an aliphatic polyol compound, and more preferably contains an aliphatic diol.

<8> The process for producing a toner for electrophotography according to the item <7>, wherein the number of carbon atoms of the aliphatic diol is preferably 2 or more, more preferably 4 or more, further preferably 6 or more, further preferably 9 or more, and further preferably 11 or more, and is preferably 20 or less, more preferably 16 or less, and further preferably 14 or less.

<9> The process for producing a toner for electrophotography according to any one of the items <6> to <8>, wherein the carboxylic acid component of the crystalline resin (C) preferably contains an aromatic dicarboxylic acid.

<10> The process for producing a toner for electrophotography according to any one of the items <6> to <9>, wherein the carboxylic acid component of the crystalline resin (C) preferably contains an aliphatic dicarboxylic acid.

<11> The process for producing a toner for electrophotography according to the item <10>, wherein the number of carbon atoms of the aliphatic dicarboxylic acid is preferably 2 or more, more preferably 6 or more, further preferably 9 or more, and further preferably 10 or more, and is preferably 26 or less, more preferably 20 or less, further preferably 16 or less, and further preferably 14 or less.

<12> The process for producing a toner for electrophotography according to any one of the items <6> to <11>, wherein the crystalline resin (C) is a resin having at least an ester moiety that is a polycondensate of an alcohol component containing an aliphatic diol having a number of carbon atoms of 9 or more and 14 or less and a carboxylic acid component containing an aliphatic dicarboxylic acid compound having a number of carbon atoms of 9 or more and 14 or less.

<13> The process for producing a toner for electrophotography according to any one of the items <6> to <12>, wherein the crystalline resin (C) preferably has a polyester segment containing the polyester moiety, and a styrene resin segment.

<14> The process for producing a toner for electrophotography according to any one of the items <1> to <13>, wherein the content of the crystalline resin (C) in the mixture is preferably 1% by mass or more, more preferably 2% by mass or more, further preferably 3% by mass or more, and further preferably 4% by mass or more, and is preferably 30% by mass or less, more preferably 20% by mass or less, further preferably 15% by mass or less, and further preferably 12% by mass or less, based on the total amount of the resin C and the resin A.

<15> The process for producing a toner for electrophotography according to any one of the items <1> to <14>, wherein the content of the crystalline resin (C) in the mixture is preferably 1% by mass or more, more preferably 2% by mass or more, further preferably 3% by mass or more, and further preferably 4% by mass or more, and is preferably 30% by mass or less, more preferably 20% by mass or less, further preferably 15% by mass or less, and further preferably 12% by mass or less, based on the total amount of the mixture.

<16> The process for producing a toner for electrophotography according to any one of the items <1> to <15>, wherein the mixture further contains an amorphous resin (A).

<17> The process for producing a toner for electrophotography according to the item <16>, wherein the amorphous resin (A) has at least a polyester moiety obtained through polycondensation of an alcohol component and a carboxylic acid component.

<18> The process for producing a toner for electrophotography according to the item <16> or <17>, wherein the amorphous resin (A) is at least one selected from a polyester, and a composite resin having a polyester segment and a styrene resin segment.

<19> The process for producing a toner for electrophotography according to any one of the items <16> to <18>, wherein the content of the amorphous resin (A) in the mixture is preferably 70% by mass or more, more preferably 80% by mass or more, and further preferably 90% by mass or more, and is preferably 99% by mass or less, more preferably 98% by mass or less, further preferably 97% by mass or less, and further preferably 96% by mass or less, based on the total amount of the resin C and the resin A.

<20> The process for producing a toner for electrophotography according to any one of the items <16> to <19>, wherein the content of the amorphous resin (A) in the mixture is preferably 40% by mass or more, more preferably 50% by mass or more, further preferably 60% by mass or more, further preferably 70% by mass or more, and further preferably 80% by mass or more, and is preferably 99% by mass or less, more preferably 96% by mass or less, further preferably 93% by mass or less, and further preferably 90% by mass or less, based on the total amount of the mixture.

<21> The process for producing a toner for electrophotography according to any one of the items <1> to <20>, wherein the ester wax (W) has a dipentaerythritol unit as a constitutional component.

<22> The process for producing a toner for electrophotography according to any one of the items <1> to <21>, wherein the ester wax (W) is preferably a fatty acid ester of dipentaerythritol.

<23> The process for producing a toner for electrophotography according to any one of the items <1> to <22>, wherein the fatty acid as a constitutional component of the ester wax (W) is preferably a straight-chain fatty acid.

<24> The process for producing a toner for electrophotography according to any one of the items <1> to <23>, wherein the number of carbon atoms of the fatty acid as a constitutional component of the ester wax (W) is preferably 8 or more, more preferably 10 or more, further preferably 12 or more, and further preferably 14 or more, and is preferably 30 or less, more preferably 26 or less, further preferably 24 or less, and further preferably 20 or less.

<25> The process for producing a toner for electrophotography according to any one of the items <1> to <24>, wherein the ester wax (W) contains a fatty acid as a constitutional component, and the fatty acid preferably contains at least one selected from lauric acid, myristic acid, palmitic acid, and stearic acid, more preferably contains at least one selected from myristic acid, palmitic acid, and stearic acid, and further preferably contains stearic acid.

<26> The process for producing a toner for electrophotography according to any one of the items <1> to <25>, wherein the melting point $W_{mp}$ of the ester wax (W) is preferably 60° C. or more, more preferably 65° C. or more, and further preferably 70° C. or more, and is preferably 150°

C. or less, more preferably 135° C. or less, further preferably 120° C. or less, and further preferably 100° C. or less.

<27> The process for producing a toner for electrophotography according to any one of the items <1> to <26>, wherein the hydroxyl value of the ester wax (W) is preferably 0.01 mgKOH/g or more, more preferably 0.05 mgKOH/g or more, and further preferably 0.1 mgKOH/g or more, and is preferably 3 mgKOH/g or less, more preferably 2 mgKOH/g or less, further preferably 1 mgKOH/g or less, and further preferably 0.5 mgKOH/g or less.

<28> The process for producing a toner for electrophotography according to any one of the items <1> to <27>, wherein the content of the ester wax (W) in the mixture is preferably 0.5 part by mass or more, more preferably 1 part by mass or more, further preferably 2 parts by mass or more, and further preferably 3 parts by mass or more, and is preferably 30 parts by mass or less, more preferably 20 parts by mass or less, further preferably 15 parts by mass or less, further preferably 12 parts by mass or less, further preferably 7 parts by mass or less, and further preferably 4 parts by mass or less, per 100 parts by mass of the total amount of the crystalline resin (C) and the amorphous resin (A).

<29> The process for producing a toner for electrophotography according to any one of the items <1> to <28>, wherein the content of the ester wax (W) in the mixture is preferably 0.4% by mass or more, more preferably 0.8% by mass or more, further preferably 2.0% by mass or more, and further preferably 2.5% by mass or more, and is preferably 30% by mass or less, more preferably 20% by mass or less, further preferably 15% by mass or less, further preferably 12% by mass or less, further preferably 7% by mass or less, and further preferably 4% by mass or less, based on the total amount of the mixture.

<30> The process for producing a toner for electrophotography according to any one of the items <1> to <29>, wherein the melt-mixing in the step 1 is performed with a kneader.

<31> The process for producing a toner for electrophotography according to any one of the items <1> to <30>, wherein the melt-mixing temperature $K_t$ is preferably 80° C. or more, more preferably 90° C. or more, and further preferably 100° C. or more, and is preferably 150° C. or less, more preferably 140° C. or less, and further preferably 130° C. or less.

<32> The process for producing a toner for electrophotography according to any one of the items <1> to <31>, wherein the process further includes step 2: pulverizing and classifying the melt-mixture obtained in the step 1.

<33> The process for producing a toner for electrophotography according to the item <32>, wherein the process further includes step 3: mixing the powder obtained through classification in the step 2, with an external additive.

EXAMPLES

The property values of the resins and the like were measured and evaluated in the following manners.

[Measurement Methods of Properties]

[Softening Point of Resin]

By using a flow tester, "CFT-500D" (produced by Shimadzu Corporation), 1 g of a sample was extruded through a nozzle having a diameter of 1 mm and a length of 1 mm under application of a load of 1.96 MPa thereto with a plunger while heating the sample at a temperature rising rate of 6° C./min. The descent amount of the plunger of the flow tester was plotted with respect to the temperature, and the temperature, at which a half amount of the sample flowed out, was designated as the softening point.

[Glass Transition Temperature of Resin]

By using a differential scanning calorimeter, "Q-20" (produced by TA Instruments Japan Inc.), from 0.01 to 0.02 g of a sample weighed on an aluminum pan was heated to 200° C. and then cooled from that temperature to 0° C. at a temperature decreasing rate of 10° C./min. The sample was then heated at a temperature rising rate of 10° C./min and measured.

The intersection point of the extended line of the base line below the maximum endothermic peak temperature and the tangential line showing the maximum gradient between the rising part of the peak and the apex of the peak was designated as the glass transition temperature.

[Maximum Endothermic Peak Temperature and Melting Point of Resin]

By using a differential scanning calorimeter, "Q-100" (produced by TA Instruments Japan Inc.), from 0.01 to 0.02 g of a sample weighed on an aluminum pan was cooled from room temperature to 0° C. at a temperature decreasing rate of 10° C./min and held for 1 minute. Thereafter the sample was measured at a temperature rising rate of 50° C./min. The temperature of the peak that had the highest temperature among the endothermic peaks observed was designated as the maximum endothermic peak temperature of the resin. The maximum peak temperature that had a difference of 20° C. or less from the softening temperature was designated as the melting point.

[Acid Value and Hydroxyl Value of Resin]

The acid value and the hydroxyl value of the resin were measured according to the method of JIS K0070. Only the measurement solvent was changed from a mixed solvent of ethanol and ether defined in JIS K0070 to a mixed solvent of acetone and toluene (acetone/toluene=1/1 (volume ratio)).

[Melting Point of Release Agent (Wax)]

By using a differential scanning calorimeter, "Q-20" (produced by TA Instruments Japan Inc.), a sample was heated to 200° C. at a temperature rising rate of 10° C./min, and the maximum endothermic peak temperature observed in the melt endothermic curve obtained thereon was designated as the melting point of the release agent.

[Acid Value and Hydroxyl Value of Ester Wax]

The acid value of the ester wax was measured according to the method of JOCS 2.3.1, and hydroxyl value thereof was measured according to the method of JOCS 2.3.6.2.

[Number Average Particle Diameter of External Additive]

The average particle diameter of the external additive means the number average particle diameter thereof. The particle diameters (i.e., the average value of the major diameter and the minor diameter) of 500 particles were measured on a micrograph of a scanning electron microscope (SEM), and the number average value was designated as the number average particle diameter.

[Volume Median Particle Diameter ($D_{50}$) of Toner Particles]

The volume median particle diameter ($D_{50}$) of the toner particles was measured in the following manner.

Measuring device: Coulter Multisizer II (produced by Beckman Coulter Inc.)

Aperture diameter: 100 μm

Analysis software: Coulter Multisizer AccuComp, ver. 1.19 (produced by Beckman Coulter Inc.)

Electrolytic solution: Isoton II (produced by Beckman Coulter Inc.)

Dispersion liquid: Emulgen 109P (produced by Kao Corporation, polyoxyethylene lauryl ether, HLB: 13.6) was dissolved in the electrolytic solution to make a concentration of 5% by mass.

Dispersion condition: 10 mg of a measurement sample was added to 5 mL of the dispersion liquid and dispersed with an ultrasonic dispersing device for 1 minute, and 25 mL of the electrolytic solution was then further added thereto and dispersed with an ultrasonic dispersing device for 1 minute, thereby preparing a sample dispersion liquid.

Measurement condition: The sample dispersion liquid was added to 100 mL of the electrolytic solution to make a concentration capable of measuring 30,000 particles for 20 seconds, 30,000 particles were measured, and the volume median diameter ($D_{50}$) was obtained from the particle size distribution of the particles.

[Test Method]

[Low-Temperature Fusing Property]

The toner was charged in a printer, "Oki Microline 5400" (produced by Oki Data Corporation) having been modified to be capable of obtaining an unfused image, and an unfused image of a solid image of a 2 cm square was printed. The unfused image was subjected to a fusing treatment with an external fusing device obtained by modifying "Oki Microline 3010" (produced by Oki Data Corporation) at a rotating speed of the fusing roll of 150 mm/sec and temperatures of the fusing roll between 100° C. and 230° C. with a step of 5° C., so as to provide fused images. An adhesive mending tape (produced by Sumitomo 3M, Ltd.) was attached to each of the images obtained at the fusing temperatures, and then a weight of 500 g in the form of cylinder (diameter: 3 cm) was placed thereon, so as to adhere the tape to the fused image sufficiently. Thereafter, the adhesive mending tape was slowly released from the fused image. The image densities of the fused images before attaching the tape and after releasing the tape were measured with an image density measuring device, "Gretag SPM50" (produced by Gretag Macbeth Company), and the temperature, at which the ratio of the image densities before attaching the tape and after releasing the tape ((image density after attaching the tape)/(image density before releasing the tape)×100) firstly exceeded 85%, was designated as the minimum fusing temperature, which was used as an index of the low-temperature fusing property. A smaller value thereof shows better low-temperature fusing property. Specifically, 140° C. or less is preferable, and 135° C. or less is more preferable.

[Initial Image Quality after Storage]

The toner was charged in a cartridge for a printer, "Oki Microline 5400" (produced by Oki Data Corporation), and stored under an environment of a temperature of 40° C. and a relative humidity of 50% for 48 hours. After returning to room temperature, the cartridge was mounted on a printer, and 10 sheets of rectangular solid images of 10 cm×20 cm were printed. The presence of density unevenness due to the blade nip was visually confirmed, and was used as the index of the initial image quality after storage according to the following evaluation standard.

A: The number of sheets suffering density unevenness was from 0 to 2.

B: The number of sheets suffering density unevenness was from 3 to 7.

C: The number of sheets suffering density unevenness was from 8 to 10.

[Document Offset Property]

The toner was charged in a printer, "Oki Microline 5400" (produced by Oki Data Corporation), and nine solid images each of 2 cm square were printed on coated paper. Blank coated paper was superimposed on the printed sample, and stored under an environment of a temperature of 50° C. and a relative humidity of 80% for 120 hours. After returning to room temperature, the blank coated paper was released from the sample, and whether or not the toner was attached to the blank coated paper was visually confirmed, and was used as the index of the document offset property according to the following evaluation standard.

A: From 0 to 2 images among the nine images were attached to the blank coated paper.

B: From 3 to 6 images among the nine images were attached to the blank coated paper.

C: From 7 to 9 images among the nine images were attached to the blank coated paper.

Production Examples of Amorphous Composite Resin

Production Examples A1, A2, and A4 (Resin A-1, A-2, and A-4)

The raw material monomers and the esterification catalyst shown in Table 1 except for trimellitic anhydride were placed in a 10-L four-neck flask equipped with a nitrogen introducing tube, a dehydration tube, a stirrer, and a thermocouple, and reacted at 230° C. for 12 hours, and were then further reacted at 8.3 kPa for 1 hour. Thereafter, the temperature was decreased to 160° C., and the raw material monomers of the styrene resin, the bireactive monomer, and dicumyl peroxide were added dropwise thereto with a dropping funnel over 1 hour. After the addition polymerization reaction was aged for 1 hour while retaining the temperature to 160° C., the temperature was raised to 210° C., and the raw material monomers of the styrene resin were removed at 8.3 kPa for 1 hour.

Trimellitic anhydride was added at 210° C., and the reaction was performed until the desired softening point was obtained, so as to provide amorphous composite resins A-1, A-2, and A-4. The properties of the resulting resins are shown in Table 1.

TABLE 1

| | | | | Production Example | | | | | |
|---|---|---|---|---|---|---|---|---|---|
| | | | | A1 | | A2 | | A4 | |
| | | | | Resin | | | | | |
| | | | | A-1 | | A-2 | | A-4 | |
| | | | | part by mol *3 | charged amount (g) | part by mol *3 | charged amount (g) | part by mol *3 | charged amount (g) |
| Raw material monomer | Raw material monomer of | Alcohol component | BPA-PO * | 70 | 3920 | 70 | 3798 | 70 | 3920 |
| | | | BPA-EO *2 | 30 | 1560 | 30 | 1511 | 30 | 1560 |

TABLE 1-continued

| | | | Production Example | | | | | |
|---|---|---|---|---|---|---|---|---|
| | | | A1 | | A2 | | A4 | |
| | | | Resin | | | | | |
| | | | A-1 | | A-2 | | A-4 | |
| polyester (P) | Acid component | Terephthal c acid | 67 | 1781 | 66 | 1700 | 73 | 1941 |
| | | Dodecenyl succinic acid | — | — | 10 | 415 | — | — |
| | | Trimellitic anhydride | 10 | 307 | 5 | 149 | 6 | 184 |
| Bireactive monomet (D) | | Acrylic acid | 5 | 58 | 5 | 56 | 5 | 58 |
| | | | % by mass *4 | charged amount (g) | % by mass *4 | charged amount (g) | % by mass *4 | charged amount (g) |
| Raw material monomer of styrene resin (A) | | Styrene | 84 | 1401 | 84 | 1401 | 84 | 1405 |
| | | 2-Ethylhexyl acrylate | 16 | 267 | 16 | 267 | 16 | 268 |
| Polymerization initiator | | Dicumyl peroxide | 6 | 100 | 6 | 100 | 6 | 100 |
| Esterification catalyst | | Tin(II) 2-ethylhexanoate | 38 g | | 38 g | | 38 g | |
| Total amount of P and D/total amount of A (mass ratio) | | | 81/19 | | 81/19 | | 81/19 | |
| Properties of resin | Softening point (° C.) | | 134 | | 136 | | 116 | |
| | Glass transition temperature (° C.) | | 59 | | 57 | | 58 | |
| | Maximum endothermic peak temperature (° C.) | | 62 | | 61 | | 60 | |
| | Softening point/maximum endothermic peak temperature | | 2.2 | | 2.2 | | 1.9 | |
| | Acid value (mgKOH/g) | | 6.1 | | 4.7 | | 5.9 | |

*1 BPA-PO: polyoxypropylene(2.2)-2,2-bis(4-hydroxyphenyl)propane
*2 BPA-EO: polyoxyethylene(2.2)-2,2-bis(4-hydroxyphenyl)propane
*3 molar number per 100 moles of total amount of alcohol components
*4 percentage by mass based on total amount of raw material monomers of addition polymerization resin (i.e., only monomers except for polymerization initiator)

Production Example of Amorphous Polyester Resin

Production Example A3 (Resin A-3)

The raw material monomers and the esterification catalyst shown in Table 2 except for trimellitic anhydride were placed in a 10-L four-neck flask equipped with a nitrogen introducing tube, a dehydration tube, a stirrer, and a thermocouple, and reacted under a nitrogen atmosphere at a temperature raised to 200° C. for 6 hours. Furthermore, after raising the temperature to 210° C., trimellitic anhydride was added, and reacted under ordinary pressure (101.3 kPa) for 1 hour, and the reaction was performed at 40 kPa until the desired softening point was obtained, so as to provide amorphous polyester resin A-3. The properties of the resulting resin are shown in Table 2.

TABLE 2

| | | | Production Example A3 Resin A-3 | |
|---|---|---|---|---|
| | | | part by mol *3 | charged amount (g) |
| Raw material monomer | Alcohol component | BPA-PO *1 | 70 | 3920 |
| | | BPA-EO *2 | 30 | 1560 |
| | Carboxylic acid component | Terephthalic acid | 57 | 1515 |
| | | Dodecenyl succinic acid | 13 | 557 |
| | | Adipic acid | — | — |
| | | Trimellitic anhydride | 15 | 461 |
| | Esterification catalyst | Tin(II) 2-ethylhexanoate | 40 g | |
| Properties of resin | Softening point (° C.) | | 135 | |
| | Glass transition temperature (° C.) | | 61 | |
| | Maximum endothermic peak temperature (° C.) | | 63 | |
| | Softening point/maximum endothermic peak temperature | | 2.1 | |
| | Acid value (mgKOH/g) | | 8.8 | |

*1 BPA-PO: polyoxypropylene(2.2)-2,2-bis(4-hydroxyphenyl)propane
*2 BPA-EO: polyoxyethylene(2.2)-2,2-bis(4-hydroxyphenyl)propane
*3 molar number per 100 moles of total amount of alcohol components Production Example of Crystalline Resin (C)

Production Examples C1, C2, and C4 (Resins C-1, C-2, and C-4)

The raw material monomers of the polyester component and the esterification catalyst shown in Table 3 were placed in a 10-L four-neck flask equipped with a nitrogen introducing tube, a dehydration tube, a stirrer, and a thermocouple, and the mixture was heated to 160° C.; and reacted for 6 hours. Thereafter, the raw material monomer of the styrene resin and the bireactive monomer shown in Table 3 were added dropwise thereto with a dropping funnel over 1 hour. After the addition polymerization reaction was aged for 1 hour while retaining the temperature to 160° C., and the raw material monomer of the styrene resin were removed at 8.3 kPa for 1 hour. The temperature was raised to 200° C. over 8 hours, and reaction was performed at 8.3 kPa for 2 hours, so as to provide crystalline resins C-1, C-2, and C-4. The properties of the resulting resins are shown in Table 3.

Production Example C3 (Resin C-3)

The raw material monomers and the esterification catalyst shown in Table 3 were placed in a 10-L four-neck flask equipped with a nitrogen introducing tube, a dehydration tube, a stirrer, and a thermocouple, and under a nitrogen atmosphere, the temperature was raised from 130° C. to 200° C. over 10 hours, and the reaction was performed at 200° C. and 8 kPa for 1 hour, so as to provide a crystalline resin C-3. The properties of the resulting resin are shown in Table 3.

Production Example C5 (Resin C-5)

The raw material monomers, the esterification catalyst, and the polymerization inhibitor shown in Table 3 were placed in a 10-L four-neck flask equipped with a nitrogen introducing tube, a dehydration tube, a stirrer, and a thermocouple, and under a nitrogen atmosphere, the temperature was raised from 130° C. to 200° C. over 10 hours, and the reaction was performed at 200° C. and 8 kPa for 1 hour, so as to provide a crystalline resin C-5. The properties of the resulting resin are shown in Table 3.

TABLE 3

| | | | | Production Example | | | | | |
|---|---|---|---|---|---|---|---|---|---|
| | | | | C1 | | C2 | | C3 | |
| | | | | Crystalline resin | | | | | |
| | | | | C-1 | | C-2 | | C-3 | |
| | | | | part by mol *1 | charged amount (g) | part by mol *1 | charged amount (g) | part by mol *1 | charged amount (g) |
| Raw material monomer | Raw material monomer of polyester (P) | Alcohol component | 1,12-Dodecanediol | 100 | 4047 | — | — | — | — |
| | | | 1,10-Decanediol | — | — | 100 | 3486 | 100 | 4183 |
| | | | 1,4-Butanediol | — | — | — | — | — | — |
| | | | 1,6-Hexanediol | — | — | — | — | — | — |
| | | Acid component | Sebacic acid | 90 | 3641 | 93 | 3762 | 100 | 4854 |
| | | | Terephthalic acid | — | — | — | — | — | — |
| | | | Fumaric acid | — | — | — | — | — | — |
| | Bireactive monomer (D) | | Acrylic acid | 7 | 101 | 7 | 101 | — | — |
| | | | | % by mass *2 | charged amount (g) | % by mass *2 | charged amount (g) | % by mass *2 | charged amount (g) |
| | Raw material monomer of styrene resin component (S) | | Styrene | 100 | 1805 | 100 | 1607 | — | — |
| | Polymerization inhibitor | | Dicumyl peroxide | 6 | 108 | 6 | 96 | — | — |
| | Total amount of P + D/total amount of S (mass ratio) | | | 81/19 | | 81/19 | | 100/0 | |
| | Esterification catalyst | | Tin(II) 2-ethylhexanoate | 16 g | | 14 g | | 18 g | |
| | Polymerization inhibitor | | tert-Butyl catechol | — | | — | | — | |
| Properties of crystalline resin | Softening point (° C.) | | | 89 | | 88 | | 89 | |
| | Maximum endothermic peak temperature (melting point) (° C.) | | | 82 | | 78 | | 78 | |
| | Softening point/maximum endothermic peak temperature | | | 1.1 | | 1.1 | | 1.1 | |

TABLE 3-continued

| | | | | Production Example | | | |
|---|---|---|---|---|---|---|---|
| | | | | C4 | | C5 | |
| | | | | Crystalline resin | | | |
| | | | | C-4 | | C-5 | |
| | | | | part by mol *1 | charged amount (g) | part by mol *1 | charged amount (g) |
| Raw material monomer | Raw material monomer of polyester (P) | Alcohol component | 1,12-Dodecanediol | — | — | — | — |
| | | | 1,10-Decanediol | — | — | — | — |
| | | | 1,4-Butanediol | 30 | 756 | — | — |
| | | | 1,6-Hexanediol | 70 | 2313 | 100 | 4490 |
| | | Acid component | Sebacic acid | — | — | — | — |
| | | | Terephthalic acid | 72 | 3347 | — | — |
| | | | Fumaric acid | — | — | 100 | 4411 |
| | Bireactive monomer (D) | | Acrylic acid | 10 | 202 | — | — |
| | | | | % by mass *2 | charged amount (g) | % by mass *2 | charged amount (g) |
| | Raw material monomer of styrene resin component (S) | | Styrene | 100 | 2593 | — | — |
| | Polymerization inhibitor | | Dicumyl peroxide | 6 | 156 | — | — |
| | Total amount of P + D/total amount of S (mass ratio) | | | 72/28 | | 100/0 | |
| | Esterification catalyst | | Tin(II) 2-ethylhexanoate | 13 g | | 18 g | |
| | Polymerization inhibitor | | tert-Butyl catechol | — | | 4.5 g | |
| Properties of crystalline resin | Softening point (° C.) | | | 104 | | 110 | |
| | Maximum endothermic peak temperature (melting point) (° C.) | | | 105 | | 111 | |
| | Softening point/maximum endothermic peak temperature | | | 1.0 | | 1.0 | |

*1 molar number per 100 moles of total amount of alcohol components

*2 percentage by mass based on total amount of raw material monomers of styrene resin (i.e., only monomers except for polymerization initiator)

Production Examples of Wax

Production Examples W1 to W3 (Wax W-1 to W-3)

254 g (1.0 mol) of dipentaerythritol as an alcohol component and 1,707 g (6.0 mol) of stearic acid as a monocarboxylic acid component were placed in a 5-L four-neck flask, and under a nitrogen stream, the reaction was performed at 220° C. for 10 hours while distilling off the generated water. The product had an acid value of 7.2 mgKOH/g.

500 g of toluene, 330 g of 2-propanol, and 267 g of a 10% by mass potassium hydroxide aqueous solution were added thereto, stirred at 70° C. for 1 hour, and allowed to stand for 30 minutes, and then the aqueous layer was removed. The reaction mixture was rinsed with ion exchanged water until the pH became 7 at 70° C. The solvent was distilled off from the resulting wax-containing solution, and wax W-1 was provided through filtration, solidification, and pulverization.

Wax W-2 or W-3 was obtained in the same manner as in Production Example W1 except that the monocarboxylic acid component was changed to the component shown in Table 4.

The hydroxyl values measured for the resulting wax are shown in Table 4. Table 4 below shows the information of the wax obtained in Production Examples and the commercially available wax used in Examples.

TABLE 4

| Production Example | Wax | | Alcohol component | Monocarboxylic acid component | Hydroxyl value (mgKOH/g) | Note | Melting point (° C.) |
|---|---|---|---|---|---|---|---|
| W1 | W-1 | Kind | dipentaerythritol | stearic acid | 0.3 | | 79 |
| | | Blended amount | 254 g (1.0 mol) | 1707 g (6.0 mol) | | | |
| W2 | W-2 | Kind | dipentaerythritol | palmitic acid/stearic acid = 1/2 (by mol) | 1.1 | | 66 |
| | | Blended amount | 254 g (1.0 mol) | 531 g (2.0 mol)/1138 g (4 mol) | | | |
| W3 | W-3 | Kind | dipentaerythritol | myristic acid | 0.9 | | 65 |
| | | Blended amount | 254 g (1.0 mol) | 1368 g (6.0 mol) | | | |
| — | W-4 | | — | — | — | polypropylene wax "MITSUI HI WAX NP056" (produced by Mitsui Chemicals, Inc.) | 127 |

Production Example of Toner

Examples 1 to 12, 14, 15, and 17 and Comparative Examples 1 and 2

100 parts by mass of the binder resin and the prescribed amount of the release agent shown in Table 5, and 1.0 part by mass of the charge controlling agent, "Bontron E-304" (produced by Orient Chemical Industries, Co., Ltd.) and 3.0 parts by mass of the colorant, "ECB-301" (produced by Dainichiseika Color & Chemicals Mfg. Co., Ltd., phthalocyanine blue (P.B. 15:3)) were mixed with a Henschel mixer for 1 minute, and then melt-kneaded under the condition shown below.

A co-rotation twin screw extruder, "PCM-30" (produced by Ikegai Corporation, diameter of screw: 2.9 cm, cross sectional area of screw: 7.06 $cm^2$) was used. The operation conditions were a set temperature of the barrel of 110° C., a rotation number of the screw of 200 r/min (rotation peripheral speed of the screw of 0.30 m/sec), and a supplying rate of the mixture of 10 kg/h (supplying rate of the mixture per unit cross sectional area of the screw of 1.42 $kg/h \cdot cm^2$). The temperature of the kneaded material at the outlet port of the kneader (i.e., the melt-mixing temperature $K_t$) was measured with a non-contact thermometer. The results are shown in Table 5.

The resulting resin kneaded material was cooled, coarsely pulverized with a pulverizer, "Rotoplex" (produced by Hosokawa Micron Corporation), and a coarsely pulverized product having a volume median particle diameter of 2 mm or less was obtained with a sieve having an aperture of 2 mm. The resulting coarsely pulverized product was finely pulverized with IDS-2 type Jet Mill (collision plate type, produced by Nippon Pneumatic Mfg. Co., Ltd.) with a pulverizing pressure controlled to provide a volume median particle diameter of 8.0 μm. The resulting finely pulverized product was classified with DSX-2 type Airflow Classifier (produced by Nippon Pneumatic Mfg. Co., Ltd.) with a static pressure (internal pressure) controlled to provide a volume median particle diameter ($D_{50}$) of 8.5 μm, so as to provide toner particles.

100 parts by mass of the resulting toner particles were mixed with 0.8 part by mass of hydrophobic silica, "R972" (produced by Nippon Aerosil Co., Ltd., hydrophobizing agent: DMDS, average particle diameter: 16 nm) and 1.0 part by mass of hydrophobic silica, "RY50" (produced by Nippon Aerosil Co., Ltd., hydrophobizing agent: silicone oil, average particle diameter: 40 nm) as external additives, with a Henschel mixer (produced by Nippon Coke & Engineering. Co., Ltd.) at 2,100 r/min (peripheral speed of 29 m/sec) for 3 minutes, so as to provide a toner.

Example 13

Toner particles were obtained in the same manner as in Example 1 except that the set temperature of the barrel in the melt-kneading was changed to 90° C.

Example 16

Toner particles were obtained in the same manner as in Example 1 except that the set temperature of the barrel in the melt-kneading was changed to 70° C.

Comparative Example 3

(Production of Aqueous Dispersion A)

In a 3-L vessel equipped with a stirrer, a reflux condenser, a dropping funnel, a thermometer, and a nitrogen introducing tube, 150 g of the resin A-1 and 75 g of ethyl acetate were charged and dissolved at 70° C. over 2 hours. A 20% by mass ammonia aqueous solution (pKa: 9.3) was added to the resulting solution to make a neutralization degree of 100% by mol with respect to the acid value of the resin, and stirred for 30 minutes to provide a mixture. While retaining the temperature to 70° C., 675 g of ion exchanged water was added thereto over 77 minutes under stirring at 280 r/min (peripheral speed of 88 m/min) to perform phase inversion emulsification, and thus a crude dispersion of resin particles was obtained. While continuously retaining the temperature to 70° C., ethyl acetate was distilled off under reduced pressure, so as to provide an aqueous dispersion of resin particles.

Thereafter, the aqueous dispersion was cooled to 30° C. under stirring at 280 r/min (peripheral speed of 88 m/min), and then 16.7 g of an anionic surfactant, "Emal E27C" (sodium polyoxyethylene lauryl ether sulfate, produced by Kao Corporation, solid content: 28% by mass) was mixed therewith and completely dissolved. Thereafter, the solid concentration of the aqueous dispersion was measured, and ion exchanged water was added thereto to control the solid concentration of the aqueous dispersion to 20% by mass. The resin particles of the resulting aqueous dispersion had a volume median particle diameter ($D_{50}$) of 203 nm.

(Production of Aqueous Dispersion C)

In a 1-L beaker, 30 g of the crystalline resin C-1 and 270 g of chloroform were stirred and mixed at 25° C. to dissolve the crystalline resin C, and after adding 100 g of Neopelex G-15 (produced by Kao Corporation) thereto, the mixture was stirred with "T.K. Robomix" (produced by Primix Corporation) at a rotation number of 8,000 r/min for 30 minutes, so as to provide an emulsion liquid. Chloroform was distilled off from the resulting emulsion liquid under reduced pressure to provide an aqueous dispersion C. The aqueous dispersion C had a volume median particle diameter ($D_{50}$) of the resin particles of 287 nm and a solid concentration of 23% by mass.

(Production of Colorant Dispersion Liquid)

50 g of copper phthalocyanine, "ECB-301" (produced by Dainichiseika Color & Chemicals Mfg. Co., Ltd.), 5 g of a nonionic surfactant, "Emulgen 150" (polyoxyethylene lauryl ether, produced by Kao Corporation), and 200 g of ion exchanged water were mixed and dispersed with a homogenizer for 10 minutes, so as to provide a colorant dispersion liquid containing colorant particles. The colorant particles had a volume median particle diameter ($D_{50}$) of 120 nm and a solid concentration of 22% by mass.

(Production of Charge Controlling Agent Dispersion Liquid)

50 g of a salicylic acid compound, "Bontron E-304" (produced by Orient Chemical Industries, Co., Ltd.) as a charge controlling agent, 5 g of "Emulgen 150" (produced by Kao Corporation) as a nonionic surfactant, and 200 g of ion exchanged water were mixed, and dispersed with glass beads by using a sand grinder for 10 minutes, so as to provide a charge controlling agent dispersion liquid containing charge controlling agent particles. The charge controlling agent particles had a volume median particle diameter ($D_{50}$) of 400 nm and a solid concentration of 22% by mass.

(Production of Release Agent Dispersion Liquid)

In a 1-L beaker, 3.8 g of a sodium acrylate-sodium maleate copolymer aqueous solution (produced by Kao Corporation, Poiz 521, a trade name, effective concentration: 40% by mass) as a sodium polycarboxylate aqueous solution was dissolved in 200 g of deionized water, to which 50 g of the release agent W-1 (see the description later) was then added. While the mixture was melted by retaining the temperature of from 90 to 95° C. under stirring, the mixture was dispersed with an ultrasonic homogenizer (produced by Nippon Seiki Co., Ltd., US-600 T, a trade name) for 30 minutes and then cooled to room temperature, to which ion-exchanged water was added to provide a release agent solid content of 20% by mass, so as to provide a release agent particle dispersion liquid.

In the release agent particle dispersion liquid, the release agent particles had a volume median particle diameter ($D_{50}$) of 423 nm.

(Production of Toner)

315.0 g of the aqueous dispersion A, 42.0 g of the aqueous dispersion C, 9.5 g of the colorant dispersion liquid, 8.8 g of the release agent dispersion liquid, 3.2 g of the charge controlling agent dispersion liquid, and 60 g of deionized water were placed in a 3-L vessel, and 150 g of a 0.1% by mass calcium chloride aqueous solution was added dropwise thereto over 30 minutes at 20° C. under stirring with an anchor-type stirrer at 100 r/min (peripheral speed of 31 m/min). Thereafter, the temperature was raised to 50° C. under stirring. After the volume median particle diameter (DO reached 8.0 μm, a diluted solution obtained by diluting 4.2 g of an anionic surfactant, "Emal E27C" (produced by Kao Corporation, solid content: 28% by mass) with 37 g of deionized water as an aggregation terminating agent was added to provide an aggregate X. The temperature was then raised to 75° C., and 75° C. was retained for 1 hour from the time when the temperature reached 75° C., followed by completing the heating. Fused particles were thus produced by the procedure, and then the particles were gradually cooled to 20° C., filtered with a metal mesh of 150 mesh (aperture: 150 μm), and subjected to suction filtration, rinsing, and drying, so as to provide toner particles.

The external addition was performed in the same manner as in Example 1, and thereby a toner was obtained.

TABLE 5

| | Binder resin | | | | | | | | | |
|---|---|---|---|---|---|---|---|---|---|---|
| | Amorphous resin | | Crystalline resin | | | Wax | | | | |
| | Kind | Part by mass | Kind | Part by mass | Melting point $C_{mp}$ | Kind | Part by mass | Melting point $W_{mp}$ | $\lvert C_{mp} - W_{mp} \rvert$ (° C.) | Mixing method |
| Example 1 | A-1 | 95 | C-1 | 5 | 82 | W-1 | 3 | 79 | 3 | melt-kneading |
| Example 2 | A-1 | 95 | C-1 | 5 | 82 | W-1 | 1 | 79 | 3 | melt-kneading |
| Example 3 | A-1 | 95 | C-1 | 5 | 82 | W-1 | 5 | 79 | 3 | melt-kneading |
| Example 4 | A-1 | 95 | C-1 | 5 | 82 | W-1 | 8 | 79 | 3 | melt-kneading |
| Example 5 | A-1 | 90 | C-1 | 10 | 82 | W-1 | 3 | 79 | 3 | melt-kneading |
| Example 6 | A-1 | 85 | C-1 | 15 | 82 | W-1 | 3 | 79 | 3 | melt-kneading |
| Example 7 | A-1 | 80 | C-1 | 20 | 82 | W-1 | 3 | 79 | 3 | melt-kneading |
| Example 8 | A-1 | 95 | C-1 | 5 | 82 | W-2 | 3 | 66 | 16 | melt-kneading |
| Example 9 | A-1 | 95 | C-1 | 5 | 82 | W-3 | 3 | 65 | 17 | melt-kneading |
| Example 10 | A-1 | 95 | C-2 | 5 | 78 | W-1 | 3 | 79 | 1 | melt-kneading |
| Example 11 | A-1 | 95 | C-3 | 5 | 78 | W-1 | 3 | 79 | 1 | melt-kneading |
| Example 12 | A-1 | 95 | C-4 | 5 | 105 | W-1 | 3 | 79 | 26 | melt-kneading |
| Example 13 | A-1 | 95 | C-1 | 5 | 82 | W-1 | 3 | 79 | 3 | melt-kneading |
| Example 14 | A-2 | 95 | C-1 | 5 | 82 | W-1 | 3 | 79 | 3 | melt-kneading |
| Example 15 | A-3 | 95 | C-1 | 5 | 82 | W-1 | 3 | 79 | 3 | melt-kneading |
| Example 16 | A-4 | 95 | C-1 | 5 | 82 | W-1 | 3 | 79 | 3 | melt-kneading |
| Example 17 | A-1 | 95 | C-1 | 5 | 82 | W-1 | 2 | 79 | 3 | melt-kneading |
| | | | | | | W-4 | 1 | — | — | |
| Comparative Example 1 | A-1 | 95 | C-5 | 5 | 111 | W-3 | 3 | 65 | 46 | melt-kneading |
| Comparative Example 2 | A-1 | 95 | C-1 | 5 | 82 | W-4 | 3 | — | — | melt-kneading |
| Comparative Example 3 | A-1 | 95 | C-1 | 5 | 82 | W-1 | 3 | 79 | 3 | emulsification aggregation |

| | | | | Performance of toner | | |
|---|---|---|---|---|---|---|
| Example 1 | Mixing temperature $K_t$ *1 (° C.) | $K_t - C_{mp}$ (° C.) | $K_t - W_{mp}$ (° C.) | Minimum fusing temperature (° C.) | Initial image quality after storage | Document offset property |
| Example 2 | 122 | 40 | 43 | 130 | A | A |
| Example 3 | 126 | 44 | 47 | 135 | B | A |
| Example 4 | 123 | 41 | 44 | 130 | A | A |
| Example 5 | 121 | 39 | 42 | 130 | B | A |
| Example 6 | 119 | 37 | 40 | 130 | A | A |
| Example 7 | 117 | 35 | 38 | 130 | B | A |
| Example 8 | 117 | 35 | 38 | 125 | B | A |
| Example 9 | 123 | 41 | 57 | 130 | A | B |
| Example 10 | 121 | 39 | 56 | 130 | A | B |
| Example 11 | 124 | 46 | 45 | 135 | A | A |
| Example 12 | 123 | 45 | 44 | 130 | A | A |
| Example 13 | 119 | 14 | 40 | 140 | B | B |
| Example 14 | 108 | 26 | 29 | 135 | A | A |
| Example 15 | 124 | 42 | 45 | 135 | A | A |
| Example 16 | 121 | 39 | 42 | 140 | B | B |

TABLE 5-continued

| | | | | | | |
|---|---|---|---|---|---|---|
| Example 17 | 102 | 20 | 23 | 130 | B | B |
| | 119 | 37 | 40 | 130 | B | A |
| Comparative Example 1 | 120 | 9 | — 55 | 145 | C | C |
| Comparative Example 2 | 126 | 44 | — | 145 | C | B |
| Comparative Example 3 | 75 | −7 | −4 | 135 | C | A |

*1 In the emulsification aggregation method, the set temperature of the system was designated as $K_t$.

It is understood from the aforementioned results that as compared to Comparative Examples 1 to 3, the toners of Examples 1 to 17 are excellent in the low-temperature fusing property, the initial image quality after storage, and the document offset property.

The invention claimed is:

1. A process for producing a toner for electrophotography, comprising:

melt-mixing a mixture comprising a crystalline resin (C) and ester wax (W) having a dipentaerythritol unit as a constitutional component, wherein a difference $|C_{mp}-W_{mp}|$ between a melting point $C_{mp}$ of the crystalline resin (C) and a melting point $W_{mp}$ of the ester wax (W) is 30° C. or less;

a difference $(K_t-C_{mp})$ between $K_t$ and $C_{mp}$ is 25° C. to 50° C.; and the melt-mixing is performed at a temperature $K_t$ that is the melting point $C_{mp}$ or more and the melting point $W_{mp}$ or more.

2. The process for producing a toner for electrophotography according to claim 1, wherein a difference $(K_t-W_{mp})$ between $K_t$ and $W_{mp}$ is 25° C. to 50° C.

3. The process for producing a toner for electrophotography according to claim 1, wherein a difference $(C_{mp}-W_{mp})$ between $C_{mp}$ and $W_{mp}$ is 0° C. to 10° C.

4. The process for producing a toner for electrophotography according to claim 1, wherein the crystalline resin (C) is a resin having at least an ester moiety that is a polycondensate of an alcohol component containing an aliphatic polyol compound and a carboxylic acid component.

5. The process for producing a toner for electrophotography according to claim 1, wherein the crystalline resin (C) is a resin having at least an ester moiety that is a polycondensate of an alcohol component comprising an aliphatic diol having a number of carbon atoms of 9 to 14 and a carboxylic acid component comprising an aliphatic dicarboxylic acid compound having a number of carbon atoms of 9 to 14.

6. The process for producing a toner for electrophotography according to claim 1, wherein the ester wax (W) is a straight-chain fatty acid ester of dipentaerythritol.

7. The process for producing a toner for electrophotography according to claim 6, wherein the ester wax (W) has a hydroxyl value of 0.01 mgKOH/g to 3 mgKOH/g.

8. The process for producing a toner for electrophotography according to claim 1, wherein the mixture further comprises an amorphous resin (A).

9. The process for producing a toner for electrophotography according to claim 8, wherein a content of the ester wax (W) in the mixture is 4 parts by mass to 20 parts by mass per 100 parts by mass of the total amount of the crystalline resin (C) and the amorphous resin (A).

10. The process for producing a toner for electrophotography according to claim 8, wherein a content of the crystalline resin (C) in the mixture is 1% by mass to 30% by mass based on the total amount of the crystalline resin (C) and the amorphous resin (A).

11. The process for producing a toner for electrophotography according to claim 8, wherein the amorphous resin (A) comprises at least a polyester moiety obtained through polycondensation of an alcohol component and a carboxylic acid component.

12. The process for producing a toner for electrophotography according to claim 8, wherein the amorphous resin (A) comprises at least one selected from the group consisting of (i) a polyester, and (ii) a composite resin having a polyester segment and a styrene resin segment.

13. The process for producing a toner for electrophotography according to claim 1, wherein the melt-mixing is melt-kneading that is performed with a melt-kneader.

14. The process for producing a toner for electrophotography according to claim 1, wherein the process further comprises pulverizing and classifying a melt-mixture obtained by the melt-mixing.

15. The process for producing a toner for electrophotography according to claim 14, wherein the process further comprises mixing a powder obtained through the pulverizing and classifying, with an external additive.

16. The process for producing a toner for electrophotography according to claim 1, wherein the difference $(K_t-C_{mp})$ between $K_t$ and $C_{mp}$ is 30° C. to 50° C.

17. The process for producing a toner for electrophotography according to claim 1, wherein the difference $(K_t-W_{mp})$ between $K_t$ and $W_{mp}$ is 35° C. to 50° C.

18. The process for producing a toner for electrophotography according to claim 1, wherein the crystalline resin (C) is a composite resin having a polyester segment and a styrene resin segment.

19. The process for producing a toner for electrophotography according to claim 1, wherein a content of the ester wax (W) in the mixture is 0.4% by mass to 30% by mass, based on the total amount of the mixture.

20. The process for producing a toner for electrophotography according to claim 1, wherein a content of the resin (C) in the mixture is 1% by mass to 30% by mass, based on the total amount of the mixture.

* * * * *